US005915605A

United States Patent [19]

Blanchard

[11] Patent Number: 5,915,605

[45] Date of Patent: Jun. 29, 1999

[54] GARMENT HANGER HAVING LATERALLY ADJUSTABLE PIVOTING CLAMPS

[75] Inventor: Russell O. Blanchard, Zeeland, Mich.

[73] Assignee: Batts, Inc., Zeeland, Mich.

[21] Appl. No.: 08/936,148

[22] Filed: Sep. 22, 1997

[51] Int. Cl.[6] ..... A47G 25/48

[52] U.S. Cl. ..... 223/96; 223/91

[58] Field of Search ..... 223/95, 96, 93, 223/91, 90, 85

[56] References Cited

U.S. PATENT DOCUMENTS

| | | | |
|---|---|---|---|
| 2,303,014 | 11/1942 | Williams | 223/96 |
| 2,908,431 | 10/1959 | Campbell | 223/96 |
| 3,464,605 | 9/1969 | Apel | 223/96 |
| 3,950,829 | 4/1976 | Cohen | 223/96 |
| 4,034,903 | 7/1977 | Batts | 223/96 |
| 4,984,721 | 1/1991 | Eiley et al. | 223/96 |

*Primary Examiner*—Bibhu Mohanty
*Attorney, Agent, or Firm*—Baker & McKenzie

[57] ABSTRACT

An improved clamp-style garment hanger is provided. The hanger provides two brackets disposed on a crossbar on opposing sides of a hook. The lateral positions of the brackets are adjustable. The brackets have a garment clamp rotatably mounted on a horizontal shaft that extends between opposed side members disposed at a lower portion of the brackets. A spring-clip biases the garment engaging surfaces of opposed jaws of the clamps together and keeps the clamps engaged on the horizontal shaft of the brackets. The brackets include members that slidably engage the crossbar and provide a frictional engagement that resists bracket/clamp creep under the weight of a heavy garment. The front and rear surfaces of the crossbar also include channels which have an inner surface, an inner end and an outer end. Protruding ridges are formed on the inner surfaces of front members and rear members of each bracket such that the ridges can engage the inner surface of the channels when the bracket is assembled on the crossbar. When a bracket is moved inward or outward on the crossbar, a ridge on a front or rear member of the bracket will contact either the inner or outer end of the channel and thereby preclude further inward or outward movement.

24 Claims, 2 Drawing Sheets

GARMENT HANGER HAVING LATERALLY ADJUSTABLE PIVOTING CLAMPS

BACKGROUND OF THE INVENTION

1. Field of the Invention

This invention relates generally to garment hangers and more specifically to clamp-type garment hangers. The garment hanger of the present invention includes improved laterally adjustable pivoting clamps.

2. Description of the Related Art

Clamp-type garment hangers, that is garment hangers featuring a crossbar with two clamps disposed at opposing ends thereof, are well-known. Further, clamp-type garment hangers with clamps whose position along the crossbar is laterally adjustable are also known. However, the means for adjusting the lateral position of the clamps along the crossbar has been relatively ineffective and the present invention makes a significant contribution to that effect.

The contribution made by the present invention can be best understood after consideration of the prior art. The first garment hangers equipped with laterally adjustable clamps included a wire or metal crossbar with two metal pinch clips disposed around the crossbar. To avoid the possibility of the clips creeping along the crossbar under the weight of the garment, the frictional engagement between the clips and the crossbar was significant, making it difficult for the consumer to adjust the position of the clips along the crossbar. However, if the portion of the clips that engage the crossbar became loose or worn, the clips moved too easily along the crossbar and the garment would not hang properly. Specifically, if a pair of pants is hung from the pant cuffs from a crossbar, it is highly desirable to stretch the cuff tight between the two clips. For the consumer, this position tends to avoid wrinkling of the pants during storage in the closet. For the retailer, this position is essential for an aesthetically appealing display of the garment in the retail setting.

Plastic clamp-type garment hangers are also known. Further, garment hangers comprised of plastic crossbars and plastic clamps with laterally adjustable clamps are also known. However, the currently available laterally adjustable plastic clamps are not convenient to use or aesthetically appealing from a retail standpoint. Some plastic clamps engage the garment and crossbar so tightly that they cannot be moved once they assume the clamping position. Other plastic clamps are too loose and are disposed to creep as discussed above.

Accordingly, there is a need for a plastic clamp-style garment hanger that is aesthetically appealing and therefore useful in the retail setting and further that includes laterally adjustable clamps that are convenient to use but are not disposed to creeping along the crossbar under the weight of heavy garments such as wool slacks.

It is therefore an object of the present invention to provide an improved clamp-style garment hanger with laterally adjustable clamps.

Yet another object of the present invention is to provide an improved clamp-type garment hanger that is aesthetically pleasing as well as easy to use.

SUMMARY OF THE INVENTION

The present invention makes a significant contribution to the garment hanger art by providing an improved clamp-style garment hanger with laterally adjustable clamps that are easy to use and easy to adjust. The hanger includes a hook or hang means connected to a middle or central portion of a crossbar. The crossbar includes two ends, an upper surface, a lower surface, front surface, and a rear surface.

The hanger also includes two brackets, one slidably connected to each side of the crossbar on opposing sides of the hook. Each bracket includes at least one front member and at least one rear member connected together by an upper member and a lower member. The upper member of the bracket engages the upper surface of the crossbar and the lower member of the bracket engages the lower surface of the crossbar. The bracket can include more than one front member and more than one rear member; however, at least one front member engages the front surface of the crossbar, and at least one rear member engages the rear surface of the crossbar. The bracket also includes a pair of opposed side members which extend downward from the lower member. A horizontal shaft extends between a lower portion of the opposed side members.

The brackets are snugly connected to the crossbar by way of the frictional engagement of the surfaces of the crossbar with the upper, lower, front and rear members of the bracket; however, the brackets are not so snugly connected as to preclude lateral adjustment of the brackets with relative ease.

A garment clamp is mounted on the horizontal shaft of each bracket. The clamp is mounted so that it may rotate about the shaft without hindrance. Each clamp includes a front and rear jaw, each jaw with a detent disposed at the middle portion of the jaw for engaging the shaft of the bracket. Specifically, when first assembled, the detent disposed at the middle portion of the front jaw engages the front portion of the shaft. The detent disposed at the middle portion of the rear jaw engages the rear portion of the shaft.

Each jaw also includes a lower clamping surface and an upper end which serves as a finger or thumb grip for opening and closing the clamp. A U-shaped spring clip biases the lower clamping surfaces of the front and rear jaws together. The clip includes a front leg disposed in a slot extending down a front surface of the front jaw and a rear leg disposed in a slot extending down a rear surface of the rear jaw. The U-shaped upper end of the clip passes through and is disposed between apertures in the upper ends of the front and rear jaws. The clip firmly biases the detents of the jaws against the shaft of the bracket but not so firmly as to preclude rotation of the clamps with relative ease.

The bracket may be easily moved laterally inward by grasping the crossbar with one hand disposed on the opposing side of the hook and pushing the bracket toward the central portion or pulling the bracket toward the end of the crossbar with the other hand. The force required for lateral adjustment of the bracket is not great, but is sufficient enough so as to preclude bracket/clamp creep when a heavy garment is suspended from the two clamps.

Also in a preferred embodiment, the garment hanger includes means for limiting lateral inward and outward movement of the brackets. The means for precluding laterally inward and outward movement of the brackets includes channels which are formed in the front and rear surfaces of the crossbar on opposing sides of the hang means or hook. The channels extend from a position inward of the end of the crossbar to a position outward of the central portion of the crossbar. The channels have an inner surface, an inner end and an outer end. Complementary protruding ridges are formed on the inner surfaces of the front members and rear members of each bracket such that the ridges engage the inner surface of the channels when the bracket is assembled on the crossbar. When a bracket is moved toward the central portion of the crossbar, a ridge on a front or rear member of the bracket will contact the inner end of the channel and thereby preclude further inward movement. In a similar fashion, when a bracket is moved toward the outer ends of the crossbar, a ridge on a front or rear member of the bracket will contact the outer end of the channel and thereby preclude further outward movement.

By precluding lateral movement of the brackets in the inward direction along the crossbar, it is assured that the brackets will not contact the hook of the garment hanger. By precluding lateral movement of the brackets in the outward direction along the crossbar, it is assured that the brackets will not become separated from the crossbar by sliding off the end of the crossbar.

BRIEF DESCRIPTION OF THE DRAWINGS

These and other features, aspects, objects, and advantages of the present invention will be become better understood upon consideration of the following detailed description, appended claims and accompanying drawings where:

Figure 1:
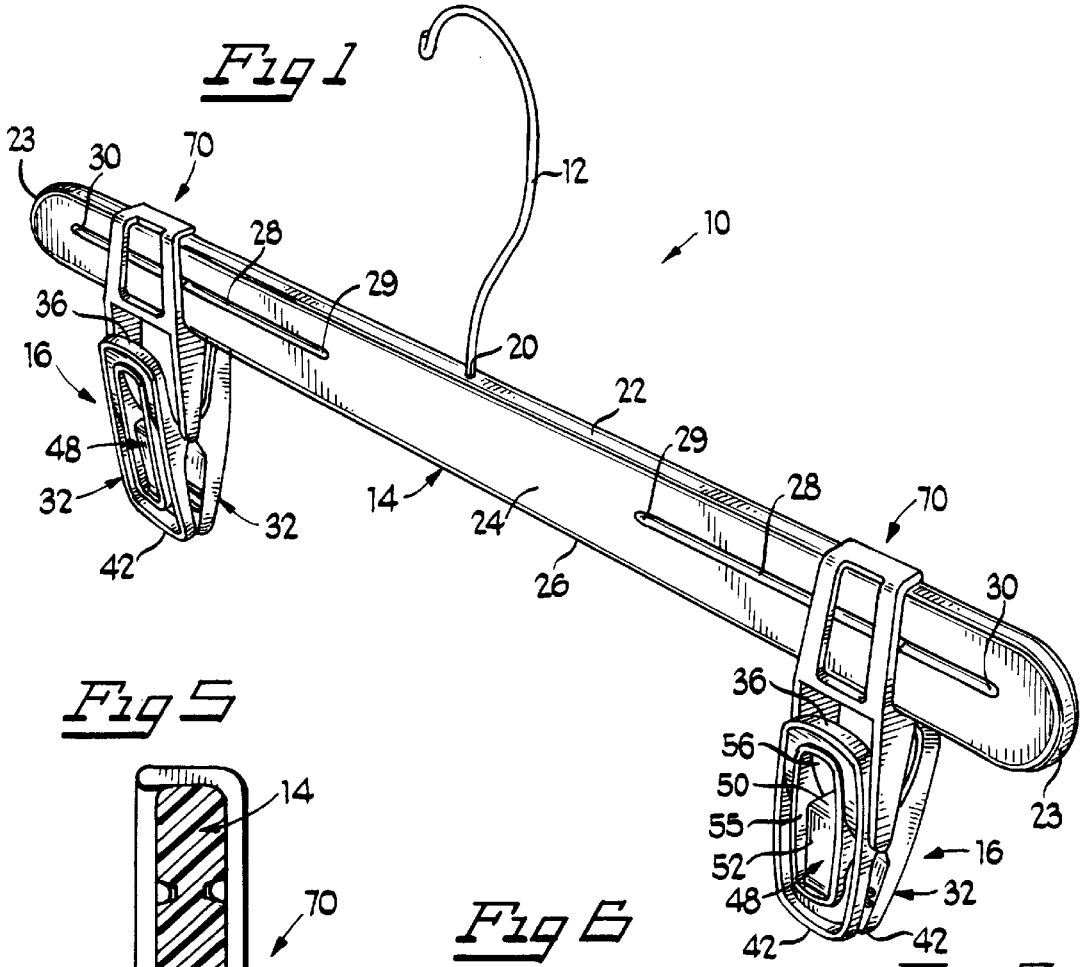
FIG. 1 is a perspective view of a garment hanger made in accordance with the present invention.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

Like reference numerals will be used to refer to like or similar parts from Figure to Figure in the following description of the drawings.

DESCRIPTION OF THE PREFERRED EMBODIMENTS

Referring now to FIGS. 1, 2A, 2B, 3 and 4, the garment hanger 10 includes a hook 12 mounted in a central portion of a crossbar 14. Two brackets, both indicated at 70, are disposed on opposing sides of the hook 12. Each of the brackets 70 has a clamp 16 disposed at its lower end. It should be noted that both of the brackets 70 and clamps 16 have identical configurations in the embodiment shown. The hook 12 is pivotably mounted in a hole indicated at 20. Other means for attaching the hook 12 to the crossbar 14 will be apparent to those skilled in the art. Further, a metallic hook similar to the one shown at 12 in FIG. 1 is not required, the hook may be plastic and may be molded integrally with the crossbar 14 or other hanging means may be provided, such as the theft proof hanging means employed in many hotels.

The crossbar 14 includes an upper surface 22, a lower surface 26, a front surface 24, a rear surface 25, and ends 23, the ends being rounded in the embodiment shown. Four channels 28 having inner surfaces 31 are provided as a means to preclude laterally inward movement of the brackets 70 inward past inner ends 29 of the channels 28 and to preclude laterally outward movement of the brackets 70 past outer ends 30 of the channels 28, as described below.

Figure 5:
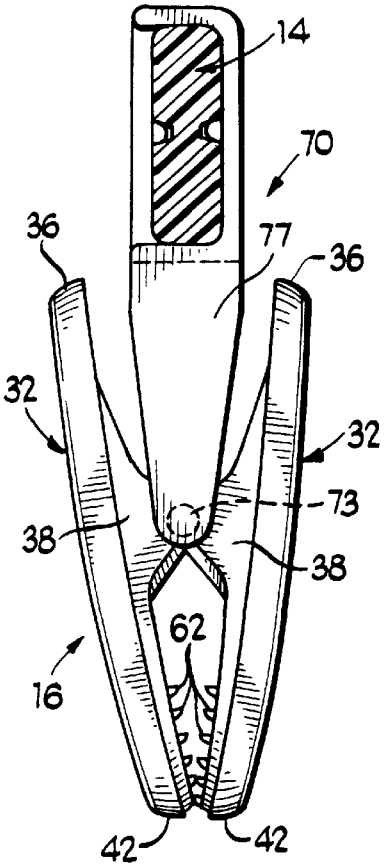
FIG. 5 is a sectional view of the crossbar, a garment hanger clamp and a bracket taken substantially along line 5—5 of FIG. 2A.
Figure 6:
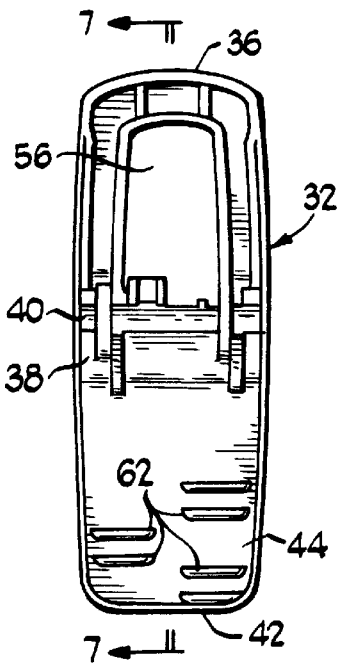
FIG. 6 is a front view of one of the jaws of the garment hanger clamp made in accordance with the present invention.
Figure 7:
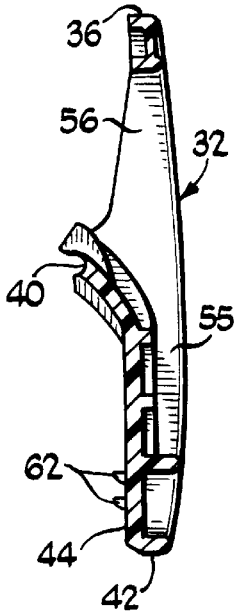
FIG. 7 is a sectional view of one of the jaws of the garment hanger clamp taken substantially along line 7—7 of FIG. 6.

Referring now to FIGS. 5–7, a clamp 16 is illustrated. The clamp 16 includes a front and rear jaw, both of which may be identical as in the case of the embodiment shown in FIG. 5. Accordingly, both jaws are indicated at 32. Further, because the front jaw 32 and the rear jaw 32 are identical in configuration, all like parts will be similarly numbered. Upper ends 36 of the jaw 32 may be ergonomically configured to accommodate finger or thumb grips. Central portion 38 of the jaw 32 includes a C-shaped detent 40 that pivotably engages a horizontal cylindrical shaft 73 of each bracket 70. A lower end 42 of each jaw 32 includes a garment engaging surface 44. In the embodiment illustrated in FIGS. 5–7, the garment engaging surfaces 44 accommodate teeth 62 which assist in gripping the garment. The lower ends 42 of the front and rear jaws 32 are spring biased together by a U-shaped clip 48 which is illustrated in FIGS. 1 and 2.

Returning to FIG. 1, the U-shaped clip 48 includes a U-shaped upper end 50, a front leg 52 and a rear leg 54. The front leg 52 and the rear leg 54 are accommodated in slots 55 disposed in the front jaw 32 and the rear jaw 32 respectively. The U-shaped upper end 50 of the U-shaped clip 48 passes through apertures 56 in the upper ends 36 of each jaw 32. The front leg 52 and the rear leg 54 of the U-shaped clip 48 are spring biased toward one another and accordingly spring bias the lower ends 42 of the jaws 32 toward each other.

Turning now to FIGS. 6 and 7, an embodiment of the jaw 32 is illustrated. Other configurations of the jaw 32 will be apparent to those skilled in the art. Turning first to FIG. 6, the jaw includes teeth 62 accommodated at the garment engaging surface 44 disposed on the lower end 42 of the jaw 32. The C-shaped detent 40 disposed in the central portion 38 of the jaw 32 accommodates the horizontal cylindrical shaft 73 of the bracket 70. The U-shaped clip 48 is inserted through the apertures 56, and the front leg 52 and rear leg 54 are accommodated in the slots 55 disposed in the front jaw 32 and the rear jaw 32 respectively. Referring now to FIG. 7, the upper end 36 of the jaw 32 may be reconfigured to provide a more ergonomically designed thumb grip or finger grip. Still other jaw configurations will be apparent to those skilled in the art.

Figures 2A, 2B, 3, 4, 8A, 8B, 9:
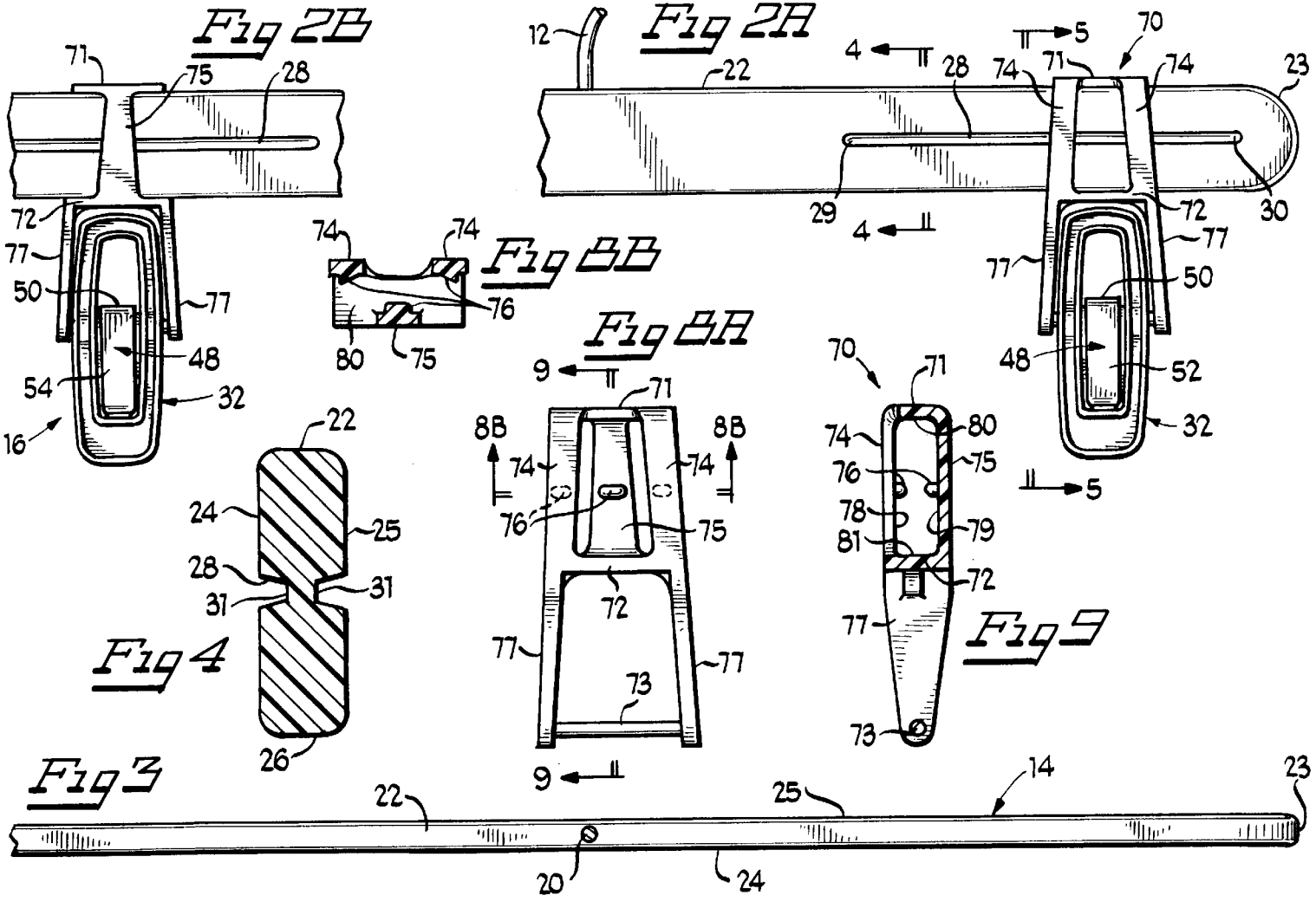
FIG. 2A is a partial front view of the garment hanger made in accordance with the present invention.
FIG. 2B is a partial rear view of the garment hanger made in accordance with the present invention.
FIG. 3 is a top view of the garment hanger made in accordance with the present invention.
FIG. 4 is a sectional view of the crossbar of the garment hanger taken substantially along line 4—4 of FIG. 2A.
FIG. 8A is a front view of a bracket upon which the jaws of the garment hanger clamp are mounted and which is laterally adjustable along the crossbar of the garment hanger.
FIG. 8B is a sectional view of the bracket taken substantially along line 8B—8B in FIG. 8A.
FIG. 9 is a sectional view of the bracket upon which the jaws of the garment hanger clamp are mounted taken substantially along line 9—9 of FIG. 8.

Referring now to FIGS. 8A, 8B and 9, one embodiment of the bracket 70 of the garment hanger 10 is shown. The bracket 70 includes an upper cross beam or member 71 having an inner surface 80, a lower cross beam or member 72 having an inner surface 81, two front vertical slats or members 74 having an inner surface 78, and a rear vertical slat or member 75 having an inner surface 79. It can be seen from FIG. 9 that the front vertical slats 74 and the rear vertical slat 75 are connected together by the upper cross beam 71 and the lower cross beam 72. In the embodiment shown in FIGS. 8A, 8B and 9, the front vertical slats 74, the rear vertical slat 75, the upper cross beam 71 and the lower cross beam 72 define a generally rectangular opening when connected together.

The front vertical slats 74 and the rear vertical slat 75 include ridges 76 which protrude outward from the inner surface 78 of the front vertical slats 74 and outward from the inner surface 79 of the rear vertical slat 75. The ridges 76 are dimensioned as to substantially conform to the shape of the inner surfaces 31 of the channels 28 in the crossbar 14. The bracket 70 also includes opposed side walls or members 77, which extend downward from the lower cross beam 72 of the bracket 70. The horizontal cylindrical shaft 73 extends between a lower portion of the side walls 77 of the bracket 70.

Referring now to FIGS. 1, 2A, 2B, 8A, 8B and 9, the lateral adjustability of the brackets 70 is illustrated. When the brackets 70 are assembled on the crossbar 14, the inner surface 78 of the front vertical slats 74 engages the front surface 24 of the crossbar 14, the inner surface 79 of the rear vertical slat 75 engages the rear surface 25 of the crossbar 14, the inner surface 80 of the upper cross beam 71 engages the upper surface 22 of the cross beam 14, and the inner surface 81 of the lower cross beam 72 engages the lower surface 26 of the crossbar 14. The brackets are thereby snugly attached to the crossbar by way of the engagement of the surfaces of the crossbar with the upper, lower, front and rear members of the bracket. However, the brackets are not so snugly attached so as to preclude lateral adjustment of the brackets with relative ease.

Either bracket 70 may be moved laterally inward toward the hook 12 until the ridge 76 on the inner surface 78 of the front vertical slat 74 nearest the central portion of the crossbar 14 contacts the inner end 29 of the channel 28, thereby precluding further inward movement. In a similar fashion, either bracket may be moved laterally outward toward an end 23 of the crossbar 14 until the ridge 76 on the inner surface 78 of the front vertical slat 74 nearest the end 23 of the crossbar 14 contacts the outer end 30 of the channel 28, thereby precluding further outward movement. It can be envisioned that lateral movement can be precluded even if only one slat has a ridge and only one channel is disposed on each side of the hook. However, in the preferred embodiment shown, each slat has a ridge in order to provide smooth stable lateral adjustability without any up and down play in the sliding bracket 70. In addition, the bracket 70 of the present invention would only require that at least one front vertical slat 74 and at least one rear vertical slat 75 of the bracket 70 engage the crossbar 14 to provide the snug sliding fit between the crossbar 14 and the bracket 70.

When each jaw 32 is assembled to the horizontal cylindrical shaft 73 of the bracket 70 by way of the U-shaped clip 48, the engagement of the C-shaped detents 40 and the horizontal cylindrical shaft 73 allows the clamps 16 to rotate about the horizontal cylindrical shaft 73 without hindrance. In other words, the clamps 16 may rotate 360° about the horizontal cylindrical shaft 73, thereby allowing a user to rotate the clamps 16 to any angle that allows easy removal and insertion of a garment into the clamps 16. For instance, when the garment hanger 10 is hung by the hook 12 on a bar in a closet, it may be easier to rotate the clamps 90°, so that the garment engaging surfaces of the clamps are parallel to the floor, before inserting a garment into the clamps.

Thus, it is seen that an improved garment hanger having laterally adjustable pivoting clamps is provided. Preferably, the crossbar is fabricated from plastic and may be provided in a variety of colors or clear plastic. It is also contemplated that the crossbar may be molded from a composite material that has a wood-like appearance. The plastic clamps are also aesthetically designed for the satisfaction of retailers. The frictional engagement between the bracket and the crossbar avoids bracket/clamp creep, yet enables the clamps to be moved relatively easily. Furthermore, the ridges formed on the inner surfaces of the front members and rear members of each bracket engage the inner surface of the channels of the crossbar and preclude lateral movement of each bracket/clamp assembly beyond the ends of the crossbar thereby keeping the bracket/clamp assembly on the crossbar. The garment hanger illustrated is easy to use and is thereby suitable for home use and further is aesthetically appealing which is required by retail establishments.

Although the present invention has been described in considerable detail with reference to certain preferred embodiments, one skilled in the art will appreciate that the present invention can be practiced by other than the preferred embodiments, which have been presented for purposes of illustration and not of limitation. Therefore, the spirit and scope of the appended claims should not be limited to the description of the preferred embodiments contained herein.

What is claimed is:

1. A laterally adjustable clamp-type garment hanger comprising:

a hang means;

the hang means connected to a central portion of a crossbar, the crossbar including two ends, an upper surface, a lower surface, a front surface and a rear surface;

two brackets slidably engaging the crossbar on opposing sides of the hang means, each bracket including opposed side members disposed below the crossbar and a horizontal shaft extending between a lower portion of the opposed side members, the brackets being capable of sliding laterally along the crossbar; and two clamps, each clamp associated with and rotatably mounted on the horizontal shaft of one of the brackets, each clamp including a front jaw and a rear jaw, each jaw including a lower clamping surface, an upper end and a central portion disposed therebetween, the lower clamping surface of the front jaw being spring biased toward the lower clamping surface of the rear jaw by a spring-biasing means, the central portion of each jaw including at least one detent for rotatably engaging the horizontal shaft of the bracket.

2. The garment hanger of claim 1, wherein the spring-biasing means is a U-shaped clip including a front leg and a rear leg connected together at a U-shaped upper end, the front leg being accommodated in a slot disposed in a front outer surface of the front jaw, the rear leg being accommodated in a slot disposed in a rear outer surface of the rear jaw, the U-shaped upper end passing through apertures disposed in the upper end of the front jaw and the upper end of the rear jaw.

3. The garment hanger of claim 1, wherein the lower clamping surfaces of the front and rear jaws include teeth for gripping a garment.

4. The garment hanger of claim 1, wherein the two clamps are capable of rotating 360 degrees about the horizontal shaft of each of the brackets without contacting the crossbar.

5. The garment hanger of claim 1, wherein the hang means is a hook.

6. The garment hanger of claim 1, wherein each bracket includes at least one front member and at least one rear member connected together by an upper member and a lower member, the upper member engaging the upper surface of the crossbar, the lower member engaging the lower surface of the crossbar, at least one front member engaging the front surface of the crossbar, and at least one rear member engaging the rear surface of the crossbar, the opposed side members of the bracket extending downward from the lower member.

7. The garment hanger of claim 6, further including means for precluding laterally inward movement of the brackets beyond a position outward of the central portion of the crossbar and for precluding laterally outward movement of the brackets beyond a position inward of each of the ends of the crossbar.

8. The garment hanger of claim 7, wherein the means for precluding laterally inward and outward movement of the brackets includes at least two channels formed in the crossbar on opposing sides of the hang means, the channels extending from a position inward of the end of the crossbar to a position outward of the central portion of the crossbar, and a ridge disposed on the inner surface of at least one of the front members or rear members of each bracket, each ridge being positioned such that the ridge slidably engages an inner surface of the channels, the ridge disposed on the front or rear member of each bracket located closest to the central portion of the crossbar contacting an inner end of the channels when each bracket is moved toward the central portion of the crossbar thereby precluding further inward movement, and the ridge disposed on the front or rear member of each bracket located closest to the ends of the crossbar contacting an outer end of the channels when each bracket is moved toward the ends of the crossbar thereby precluding further outward movement.

9. The garment hanger of claim 8, wherein the crossbar includes a pair of channels on opposing sides of the hang means in the front surface of the crossbar and a pair channels on opposing sides of the hang means in the rear surface of the crossbar, and each bracket includes two front members, one rear member and ridges disposed on the inner surface of the front and rear members of each bracket.

10. A laterally adjustable clamp-type garment hanger comprising:

a hang means;

the hang means connected to a central portion of a crossbar, the crossbar including two ends, an upper surface, a lower surface, a front surface and a rear surface;

two brackets slidably engaging the crossbar on opposing sides of the hang means, each bracket including opposed side members disposed below the crossbar and a horizontal shaft extending between a lower portion of the opposed side members, the brackets being capable of sliding laterally along the crossbar; and two clamps, each clamp associated with and rotatably mounted on the horizontal shaft of one of the brackets, each clamp including a front jaw and a rear jaw, each jaw including a lower clamping surface, an upper end and a central portion disposed therebetween, the central portion of each jaw including at least one detent for rotatably engaging the horizontal shaft of the bracket, the lower clamping surface of the front jaw being spring biased toward the lower clamping surface of the rear jaw by a U-shaped clip, the U-shaped clip including a front leg and a rear leg connected together at a U-shaped upper end, the front leg being accommodated in a slot disposed in a front outer surface of the front jaw, the rear leg being accommodated in a slot disposed in a rear outer surface of the rear jaw, the U-shaped upper end passing through apertures disposed in the upper end of the front jaw and the upper end of the rear jaw.

11. The garment hanger of claim 10, wherein the lower clamping surfaces of the front and rear jaws include teeth for gripping a garment.

12. The garment hanger of claim 10, wherein the two clamps are capable of rotating 360 degrees about the horizontal shaft of each of the brackets without contacting the crossbar.

13. The garment hanger of claim 10, wherein the hang means is a hook.

14. The garment hanger of claim 10, wherein each bracket includes at least one front member and at least one rear member connected together by an upper member and a lower member, the upper member engaging the upper surface of the crossbar, the lower member engaging the lower surface of the crossbar, at least one front member engaging the front surface of the crossbar, and at least one rear member engaging the rear surface of the crossbar, the opposed side members of the bracket extending downward from the lower member.

15. The garment hanger of claim 14, further including means for precluding laterally inward movement of the brackets beyond a position outward of the central portion of the crossbar and for precluding laterally outward movement of the brackets beyond a position inward of each of the ends of the crossbar.

16. The garment hanger of claim 15, wherein the means for precluding laterally inward and outward movement of the brackets includes at least two channels formed in the crossbar on opposing sides of the hang means, the channels extending from a position inward of the end of the crossbar to a position outward of the central portion of the crossbar, and a ridge disposed on the inner surface of at least one of the front members or rear members of each bracket, each ridge being positioned such that the ridge slidably engages an inner surface of the channels, the ridge disposed on the front or rear member of each bracket located closest to the central portion of the crossbar contacting an inner end of the channels when each bracket is moved toward the central portion of the crossbar thereby precluding further inward movement, and the ridge disposed on the front or rear member of each bracket located closest to the ends of the crossbar contacting an outer end of the channels when each bracket is moved toward the ends of the crossbar thereby precluding further outward movement.

17. The garment hanger of claim 16, wherein the crossbar includes a pair of channels on opposing sides of the hang means in the front surface of the crossbar and a pair channels on opposing sides of the hang means in the rear surface of the crossbar, and each bracket includes two front members, one rear member and ridges disposed on the inner surface of the front and rear members of each bracket.

18. A laterally adjustable clamp-type garment hanger comprising:

a hang means;

the hang means connected to a central portion of a crossbar, the crossbar including two ends, an upper surface, a lower surface, a front surface and a rear surface;

two brackets slidably engaging the crossbar on opposing sides of the hang means, each bracket including opposed side members disposed below the crossbar and a horizontal shaft extending between a lower portion of the opposed side members, the brackets being capable of sliding laterally along the crossbar;

two clamps, each clamp associated with and rotatably mounted on the horizontal shaft of one of the brackets, each clamp including a front jaw and a rear jaw, each jaw including a lower clamping surface, an upper end and a central portion disposed therebetween, the central portion of each jaw including at least one detent for rotatably engaging the horizontal shaft of the bracket, the lower clamping surface of the front jaw being spring biased toward the lower clamping surface of the rear jaw by a U-shaped clip, the U-shaped clip including a front leg and a rear leg connected together at a U-shaped upper end, the front leg being accommodated in a slot disposed in a front outer surface of the front jaw, the rear leg being accommodated in a slot disposed in a rear outer surface of the rear jaw, the U-shaped upper end passing through apertures disposed in the upper end of the front jaw and the upper end of the rear jaw; and means for precluding laterally inward movement of the brackets beyond a position outward of the central portion of the crossbar and for precluding laterally outward movement of the brackets beyond a position inward of each of the ends of the crossbar.

19. The garment hanger of claim 18, wherein each bracket includes at least one front member and at least one rear member connected together by an upper member and a lower member, the upper member engaging the upper surface of the crossbar, the lower member engaging the lower surface of the crossbar, at least one front member engaging the front surface of the crossbar, and at least one rear member engaging the rear surface of the crossbar, the opposed side members of the bracket extending downward from the lower member.

20. The garment hanger of claim 19, wherein the means for precluding laterally inward and outward movement of the brackets includes at least two channels formed in the crossbar on opposing sides of the hang means, the channels extending from a position inward of the end of the crossbar to a position outward of the central portion of the crossbar, and a ridge disposed on the inner surface of at least one of the front members or rear members of each bracket, each ridge being positioned such that the ridge slidably engages an inner surface of the channels, the ridge disposed on the front or rear member of each bracket located closest to the central portion of the crossbar contacting an inner end of the channels when each bracket is moved toward the central portion of the crossbar thereby precluding further inward movement, and the ridge disposed on the front or rear member of each bracket located closest to the ends of the crossbar contacting an outer end of the channels when each bracket is moved toward the ends of the crossbar thereby precluding further outward movement.

21. The garment hanger of claim 20, wherein the crossbar includes a pair of channels on opposing sides of the hang means in the front surface of the crossbar and a pair channels on opposing sides of the hang means in the rear surface of the crossbar, and each bracket includes two front members, one rear member and ridges disposed on the inner surface of the front and rear members of each bracket.

22. The garment hanger of claim 18, wherein the lower clamping surfaces of the front and rear jaws include teeth for gripping a garment.

23. The garment hanger of claim 18, wherein the two clamps are capable of rotating 360 degrees about the horizontal shaft of each of the brackets without contacting the crossbar.

24. The garment hanger of claim 18, wherein the hang means is a hook.

* * * * *